US011963562B1

(12) United States Patent
Grieco

(10) Patent No.: US 11,963,562 B1
(45) Date of Patent: Apr. 23, 2024

(54) PULLOVER GARMENT ASSEMBLY

(71) Applicant: David O'reilly Grieco, Los Angeles, CA (US)

(72) Inventor: David O'reilly Grieco, Los Angeles, CA (US)

( * ) Notice: Subject to any disclaimer, the term of this patent is extended or adjusted under 35 U.S.C. 154(b) by 158 days.

(21) Appl. No.: 17/142,033

(22) Filed: Jan. 5, 2021

Related U.S. Application Data

(60) Provisional application No. 63/059,057, filed on Jul. 30, 2020.

(51) Int. Cl.
*A41D 23/00* (2006.01)
*A41D 3/00* (2006.01)

(52) U.S. Cl.
CPC ..... *A41D 23/00* (2013.01); *A41D 3/005* (2013.01); *A41D 2300/332* (2013.01)

(58) Field of Classification Search
CPC ..... A41D 3/005; A41D 23/00; A41D 1/04; A41D 13/1161; A41D 13/11; A41D 13/0512; A41D 13/1153; A41D 13/1107; A42B 1/08; A41B 1/22
USPC ..... D2/500, 501, 600; 2/468
See application file for complete search history.

(56) References Cited

U.S. PATENT DOCUMENTS 5,007,115 A * 4/1991 Denbow ..... A41D 23/00 2/202
5,025,507 A * 6/1991 Kirby ..... A42B 1/046 2/202
5,414,869 A * 5/1995 Thomson ..... A41D 23/00 2/243.1
5,765,230 A * 6/1998 Sivret ..... A42B 1/046 2/202
5,822,800 A * 10/1998 Anderson ..... A42B 1/0186 2/202
6,418,559 B1 * 7/2002 Wrecsics ..... A41D 1/04 2/127
6,754,909 B1 * 6/2004 Samelian ..... A41D 13/11 2/206
6,868,852 B2 * 3/2005 Gaschke ..... A62B 9/003 128/201.13
D510,652 S * 10/2005 Edwards ..... D2/600
7,069,598 B1 * 7/2006 Welch ..... A41D 13/0051 2/129
7,836,887 B1 * 11/2010 Kling ..... A62B 23/025 128/206.16
D639,017 S * 6/2011 Saito ..... D2/600
D661,049 S * 6/2012 Hilburn ..... D2/600
(Continued)

*Primary Examiner* — Heather Mangine
(74) *Attorney, Agent, or Firm* — Plager Schack LLP; Mark H. Plager; Michael J. O'Brien

(57) ABSTRACT

A pullover garment assembly is configured to operate as a garment and a face covering. The pullover garment assembly has a pullover garment further comprising a body that is joined to sleeves and terminating with a collar at a first end and a hem at a second end. A neck gaiter extends upward from the collar from a connection portion joined to the collar to an upper hem. A flexible wishbone bridge bracket is arranged on a front portion of the neck gaiter at the upper hem. A drawstring is arranged through a channel at the upper hem and extends out of the upper hem through a rear portion of the neck gaiter. The flexible wishbone bridge bracket and the drawstring balance tension between the front portion and the rear portion.

2 Claims, 4 Drawing Sheets

(56) References Cited

U.S. PATENT DOCUMENTS 8,689,362 B2 * 4/2014 Lavin ..... A41D 13/0512 2/468
9,330,799 B1 * 5/2016 Phillips ..... G21F 3/02
9,521,873 B1 * 12/2016 Mignone ..... A41D 3/005
D843,689 S * 3/2019 Kinnear ..... D2/828
D879,412 S * 3/2020 Colbert ..... D2/831
10,863,787 B2 * 12/2020 Chen ..... A42B 3/003
D929,079 S * 8/2021 Wang ..... D2/600
D939,194 S * 12/2021 Wallace ..... D2/878
D939,809 S * 1/2022 Zagori ..... D2/853
D943,243 S * 2/2022 Meite ..... D2/831
2003/0217751 A1 * 11/2003 Patrick ..... A62B 18/084 128/205.27
2005/0028242 A1 * 2/2005 Thomas ..... A41D 1/04 2/84
2006/0085881 A1 * 4/2006 Gellis ..... A41D 13/1153 2/9
2007/0214542 A1 * 9/2007 Kim ..... A41D 27/18 2/129
2009/0235426 A1 * 9/2009 Johnston ..... A41D 3/005 2/139
2009/0276938 A1 * 11/2009 Chiang ..... A41D 13/0512 2/206
2009/0307823 A1 * 12/2009 Matsushita ..... A41D 1/04 2/116
2011/0185482 A1 * 8/2011 Godfrey ..... A41D 13/1161 2/455
2012/0023639 A1 * 2/2012 Rojas Mas ..... A42B 1/048 2/84
2013/0139291 A1 * 6/2013 Ko ..... A41D 3/005 2/84
2013/0160180 A1 * 6/2013 Carcich ..... A41D 31/0005 2/69
2013/0232654 A1 * 9/2013 Camillo ..... A41D 13/0512 2/2.5
2014/0047614 A1 * 2/2014 Becton ..... A41D 27/18 2/84
2014/0096305 A1 * 4/2014 Friesen ..... A41D 15/04 2/84
2015/0201681 A1 * 7/2015 Ron ..... A41D 31/12 2/84
2016/0157533 A1 * 6/2016 Jiménez Murat .. A41D 13/1161 2/206
2016/0213959 A1 * 7/2016 Barklow ..... A41D 13/1107
2016/0374417 A1 * 12/2016 Ross ..... A41D 19/01535 2/91
2017/0113076 A1 * 4/2017 Krespi ..... A62B 23/02
2018/0146733 A1 * 5/2018 Greenblat ..... A42B 1/046
2020/0121010 A1 * 4/2020 Scoble ..... A41D 23/00
2021/0145094 A1 * 5/2021 Diemer ..... A41D 23/00
2021/0298376 A1 * 9/2021 Stern ..... A41D 27/18
2021/0337894 A1 * 11/2021 Polley-Hoffman ..... A41D 13/1107
2021/0345704 A1 * 11/2021 Kaminski, III ..... A41D 15/00
2021/0401082 A1 * 12/2021 Roffe ..... A41D 13/1161
2022/0015491 A1 * 1/2022 Stevens ..... A42B 3/28
2022/0039493 A1 * 2/2022 Thompson ..... A41D 1/04
2022/0039497 A1 * 2/2022 Magdlen ..... A41D 13/1161
2022/0047018 A1 * 2/2022 Koos ..... A41D 13/0562
2022/0061404 A1 * 3/2022 Horwatt ..... A62B 23/02
2022/0071318 A1 * 3/2022 Lee ..... A62B 18/084
2022/0079270 A1 * 3/2022 Blackburn ..... A41D 13/1161
2022/0079276 A1 * 3/2022 Mohammadian-Khezerlou ..... A41D 27/20
2022/0087335 A1 * 3/2022 Lorenz ..... A41D 13/11
2022/0104563 A1 * 4/2022 McKelley ..... A41D 13/1161

* cited by examiner

PULLOVER GARMENT ASSEMBLY

RELATED APPLICATION

This application claims priority to provisional patent application U.S. Ser. No. 63/059,057 filed on Jul. 30, 2020 the entire contents of which is herein incorporated by reference.

BACKGROUND

The embodiments herein relate generally to clothing and personal apparel.

Prior to embodiments of the disclosed invention, neck gaiters were not effective as facial coverings because they did not have a precise fit. Embodiments of the disclosed invention solve this problem.

SUMMARY

A pullover garment assembly is configured to operate as a garment and a face covering. The pullover garment assembly has a pullover garment further comprising a body that is joined to sleeves and terminating with a collar at a first end and a hem at a second end. A neck gaiter extends upward from the collar from a connection portion joined to the collar to an upper hem. A flexible wishbone bridge bracket is arranged on a front portion of the neck gaiter at the upper hem. A drawstring is arranged through a channel at the upper hem and extends out of the upper hem through a rear portion of the neck gaiter. The flexible wishbone bridge bracket and the drawstring balance tension between the front portion and the rear portion.

A tension stabilizer arranged on the drawstring in order to maintain tension on the flexible wishbone bridge bracket. The neck gaiter is made from a piece of two ply-fabric having two ends that are both sewn to the collar such that there is no stitching at the upper hem. The neck gaiter further comprises a rear opening creating an accordion V shaped collar. A triangular tension stabilizer sewn to the rear opening. The triangular tension stabilizer is made from an elastomer fabric in order to distribute some tension from the front portion to the rear portion.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
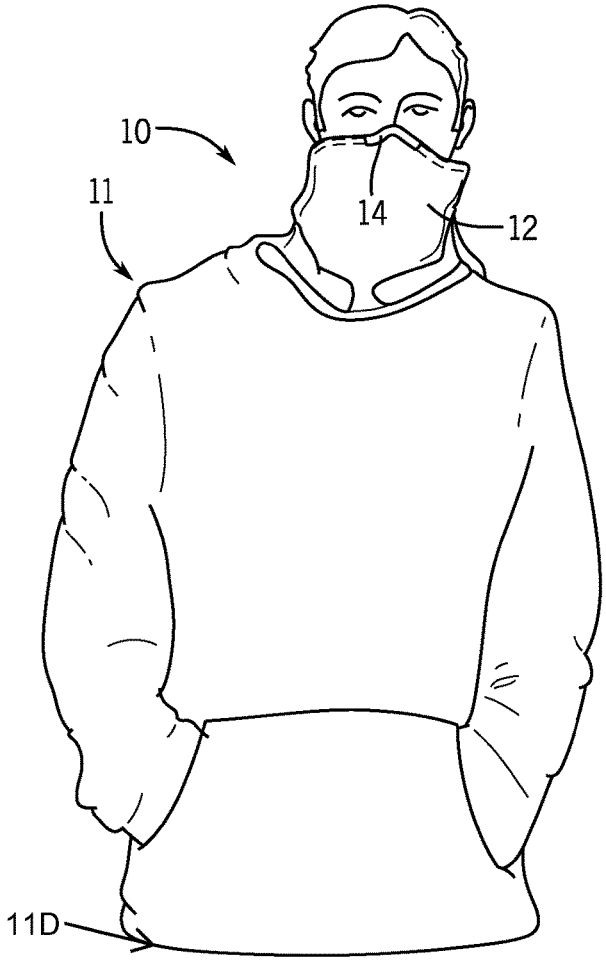
FIG. 1 shows a front elevation view of one embodiment of the present invention.
Figure 2:
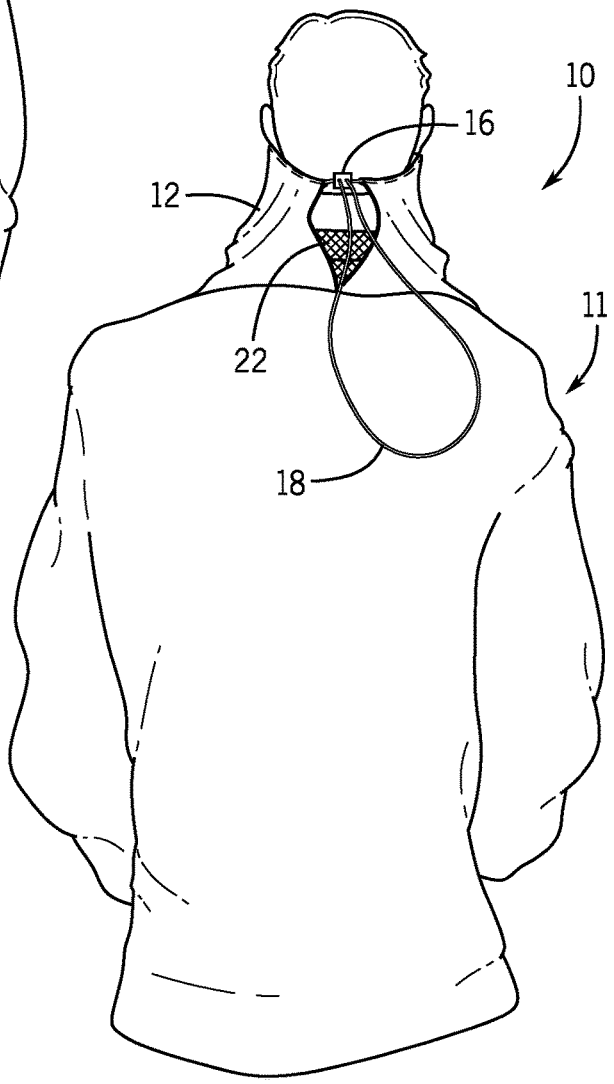
FIG. 2 shows a rear elevation view of one embodiment of the present invention.
Figure 3:
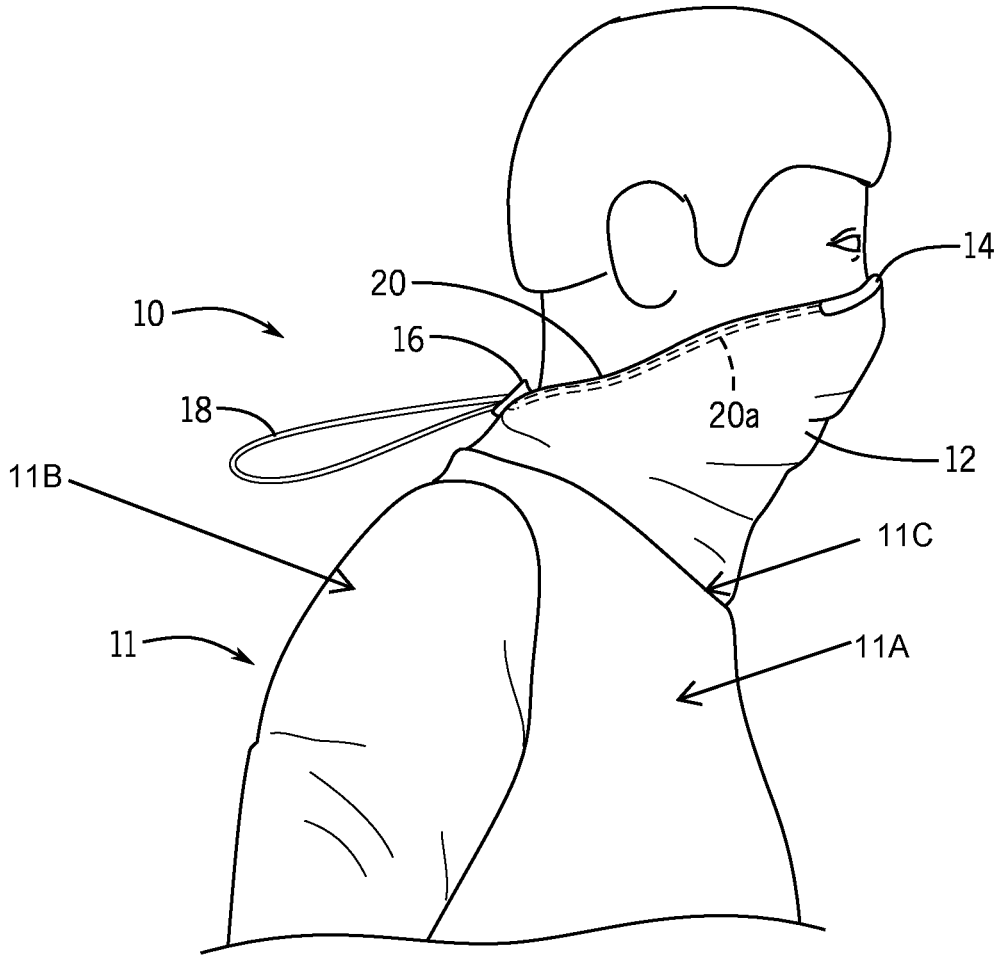
FIG. 3 shows a side elevation view of one embodiment of the present invention.
Figure 4:
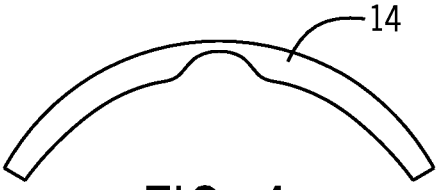
FIG. 4 shows a top plan view of one embodiment of the present invention.
Figure 5:
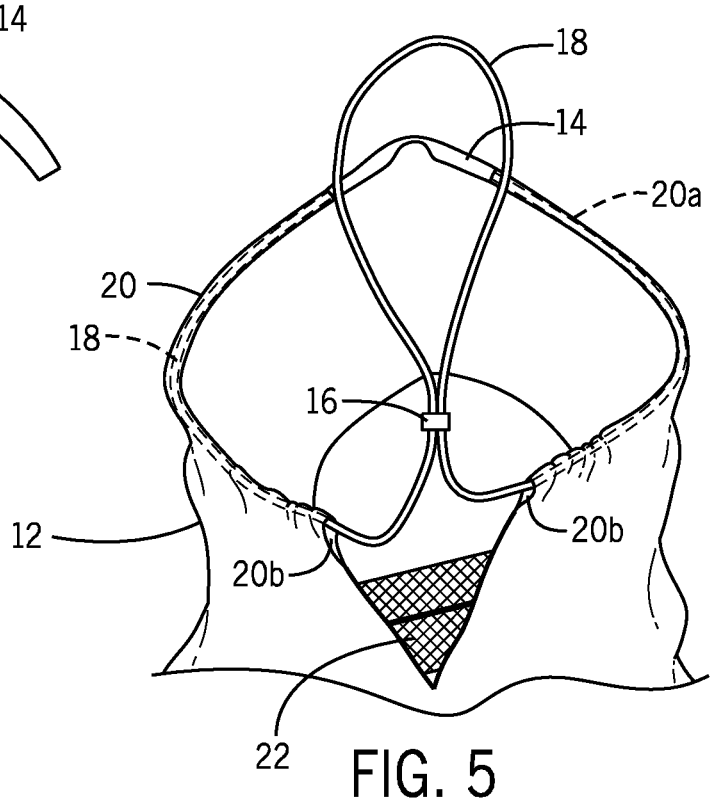
FIG. 5 shows a rear perspective view of one embodiment of the present invention.
Figure 6:
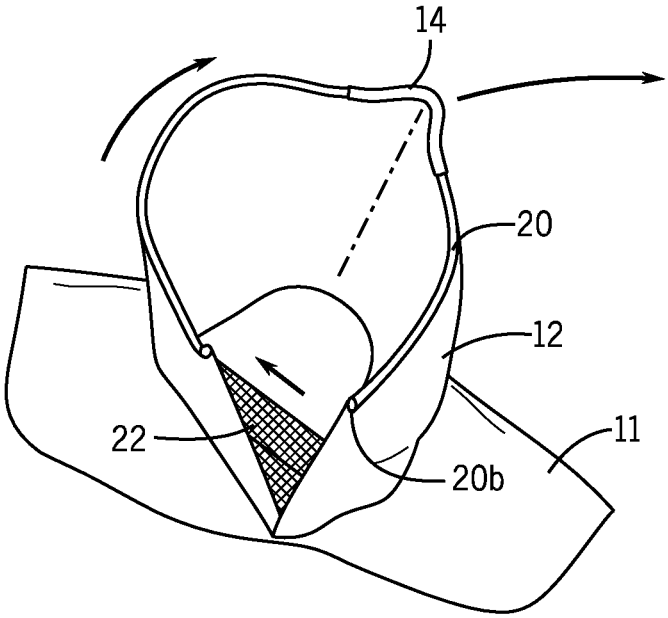
FIG. 6 shows a rear perspective view of one embodiment of the present invention showing flexure.
Figure 7:
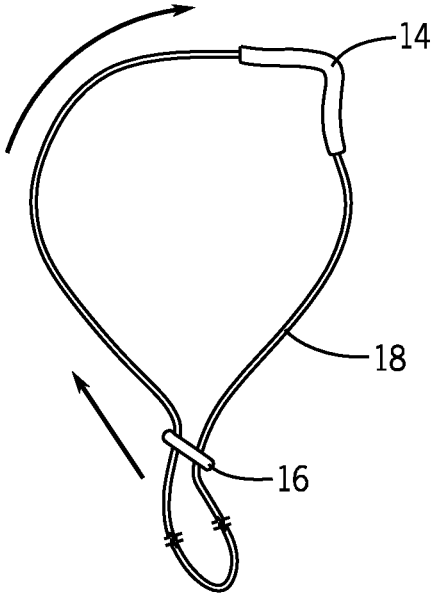
FIG. 7 shows a schematic top plan view of one embodiment of the present invention.
Figure 8:
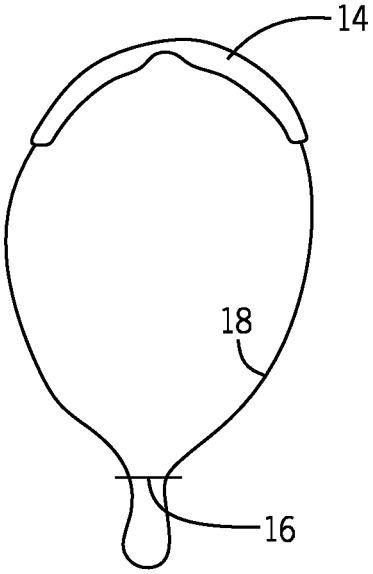
FIG. 8 shows a schematic top plan view of one embodiment of the present invention showing the flexibility of the wishbone bridge bracket.
Figure 9:
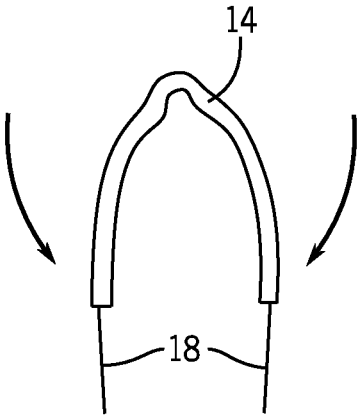
FIG. 9 shows a schematic top plan view of one embodiment of the present invention showing the flexibility of the wishbone bridge bracket.

A pullover garment assembly 10 is configured to operate as a garment and a face covering. The pullover garment assembly 10 has a pullover garment 11 further comprising a body 11A that is joined to sleeves 11B and terminating with a neck opening 11C at a first end and a hem 11D at a second end. A neck gaiter 12 extends upward from the collar from a connection portion joined to the collar to an upper end 20. A flexible wishbone bridge bracket 14 is arranged on a front portion of the neck gaiter at the upper end 20. A drawstring 18 is arranged through a channel at the upper hem 20 and extends out of the upper end 20 through a rear portion of the neck gaiter. The flexible wishbone bridge bracket 14 and the drawstring 18 balance tension between the front portion and the rear portion.

A tension stabilizer 16 is arranged on the drawstring 18 in order to maintain tension on the flexible wishbone bridge bracket. The neck gaiter 12 is made from a piece of two ply-fabric having two ends that are both sewn to the collar such that there is no stitching at the upper hem. This creates a casing 20A for the drawstring 18. The drawstring 18 extends out of the casing 20A through outlets 20B.

The neck gaiter 12 further comprises a rear opening. A triangular tension stabilizer 22 is sewn to the rear opening. The triangular tension stabilizer 22 is made from an elastomer fabric in order to distribute some tension from the front portion to the rear portion.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶

6. In particular, any use of "step of" in the claims is not intended to invoke the provision of 35 U.S.C. §112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A pullover garment assembly, comprising:

a pullover garment comprising a body joined to sleeves and terminating with a neck opening at a first end and a hem at a second end;

a neck gaiter, extending upward from the neck opening; wherein the neck gaiter extends from a connection portion joined to the neck opening to an upper end;

a flexible wishbone bridge bracket, arranged on a front portion of the neck gaiter;

a drawstring, arranged through a channel at the upper end and extending out of the upper end through a rear portion of the neck gaiter;

wherein the flexible wishbone bridge bracket and the drawstring balance tension between the front portion and the rear portion;

a tension stabilizer, arranged on the drawstring in order to maintain tension on the flexible wishbone bridge bracket;

wherein the neck gaiter is made from a piece of fabric having two ends that are both sewn to the neck opening such that there is no stitching at the upper end;

wherein the neck gaiter further comprises a rear opening; and a triangular tension stabilizer sewn to the rear opening.

2. The pullover garment assembly of claim 1, wherein the triangular tension stabilizer is made from an elastomer fabric in order to distribute some tension from the front portion to the rear portion.

* * * * *